US006079872A

United States Patent [19]

Besson

[11] Patent Number: 6,079,872

[45] Date of Patent: Jun. 27, 2000

[54] WATCH CASE

[75] Inventor: Jean-Jacques Besson, Tolochenaz, Switzerland

[73] Assignee: T Watch & Co. S.A., Lussy-Sur-Morges, Switzerland

[21] Appl. No.: 08/997,197

[22] Filed: Dec. 23, 1997

Related U.S. Application Data

[60] Provisional application No. 60/057,938, Sep. 5, 1997.

[30] Foreign Application Priority Data

Jun. 23, 1997 [XH] Hague Agreement ..... DM/003756

[51] Int. Cl.[7] ..... A44C 5/00

[52] U.S. Cl. ..... 368/281; 368/10

[58] Field of Search ..... 368/281, 278, 368/88

[56] References Cited

U.S. PATENT DOCUMENTS

| | | | |
|---|---|---|---|
| 1,954,249 | 4/1934 | Kehl | 368/278 |
| 2,166,687 | 7/1939 | Kehl | 368/278 |
| 4,183,206 | 1/1980 | Porsche et al. | 368/14 |
| 5,065,373 | 11/1991 | Maia | 368/278 |

FOREIGN PATENT DOCUMENTS

| | | | |
|---|---|---|---|
| 4236929 | 5/1994 | Germany | 368/278 |

*Primary Examiner*—Bernard Roskoski
*Attorney, Agent, or Firm*—John L. Chiatales

[57] ABSTRACT

A watch casing capable of containing an object, such as a cigar cutter, the watch casing comprising a base and a lid moveably connected to the base, where the base or the lid comprises a recess capable of holding the object. The watch face or dial is situated on the lid, which is attached to the base by a hinge, and which lid moves between and open and a closed position. In the folded position, the lid on the watch casing conceals all or most of the object contained within the watch casing, beneath the watch face or dial.

9 Claims, 5 Drawing Sheets

41
40
1

101

101
13
22
11
101

20
10
30
1

WATCH CASE

Applicant hereby claims the benefit of Provisional application No. 60/057 938, Sep. 5, 1997.

FIELD OF THE INVENTION

The present invention relates to the field of watches and watch cases.

DISCUSSION OF RELATED ART

Watches, and more specifically watches to be worn on the wrist, are well known, and may appear in a variety of sizes and shapes. It is also known for watches to have a cover which may be removed or hinged, where the cover may be used for protecting the watch face or dial.

It is also known that watches comprise a watch face or dial as well as means for changing the display on the face or dial. Such means are known to include time keeping mechanisms, power supplies, buttons or knobs for setting the time, and others.

Cases for holding and concealing objects are known. It is well known that such cases may be carried around in a user's pockets or luggage. It is also known to use a container which may have an appearance that does not inform the casual observer that the object is a container. What is desired is a container or case for holding or concealing an object where the container itself is not readily identifiable as a container, and where the container or case is a watch.

Among the types of objects which may be desired to carry in a watch casing are: money, pocket knives, cigar cutters, personal grooming equipment, fare tokens or tickets for travel, or keys. While many of these objects may be transported in a user's clothing or pockets, such objects are preferably not carried within clothing, such as sharp knives or cutting utensils.

OBJECTS OF THE INVENTION

It is an object of the present invention to utilize a watch as a storage compartment.

It is another object of the present invention to provide a means for concealing small objects from sight, while keeping the concealed objects easily available to a user.

It is a further object of the present invention to provide an alternate container for transporting small objects.

SUMMARY OF THE INVENTION

A watch casing is provided, where the watch casing comprises a lid and a base. A watch display such as a watch face or dial is situated on the lid. Means for adjusting the display may be situated on the lid or as part of the base. The base comprises a recessed compartment capable of retaining at least one object, where such object may be of any size, but when contained in the recessed compartment, the object is not expected to be larger than the watch casing. When the watch casing lid is closed, the compartment and any objects contained therein are at least partly concealed within the watch casing.

DETAILED DESCRIPTION

Figure 1A:
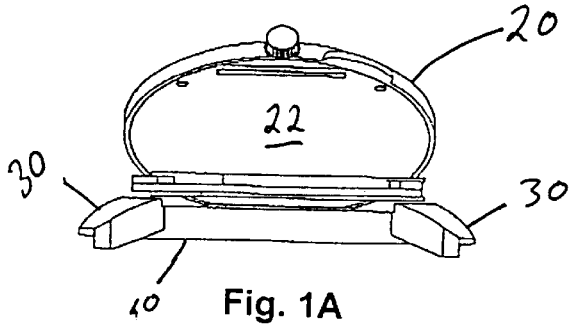
FIG. 1A is a side view of the present invention showing the watch casing open with an object within the watch casing.
Figure 1B:
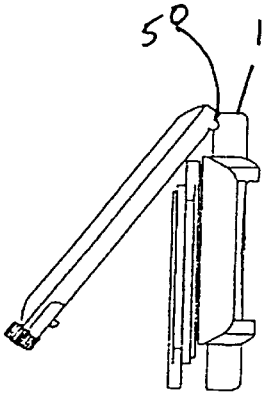
FIG. 1B is a side view of the present invention showing the watch casing open with the object within the watch casing.
Figure 1C:
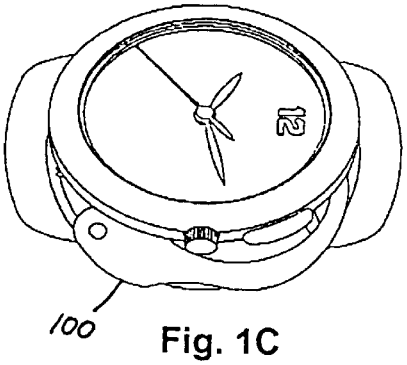
FIG. 1C is a top view of the present invention showing the watch casing open with the object within the watch casing.
Figure 1D:
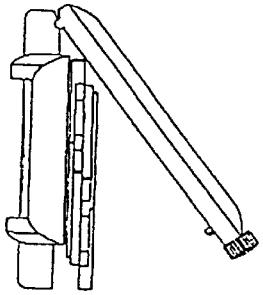
FIG. 1D is a side view of the present invention showing the watch casing open with the object within the watch casing.
Figure 1E:
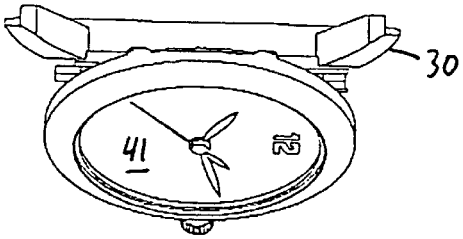
FIG. 1E is a side view of the present invention showing the watch casing open with the object within the watch casing.
Figure 1F:
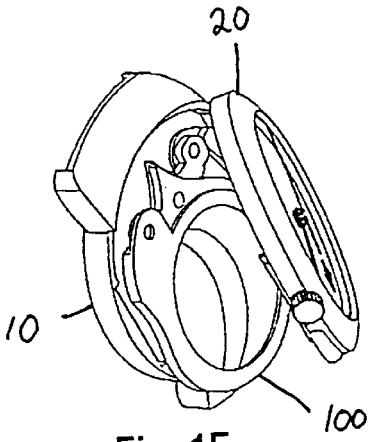
FIG. 1F is a perspective view of the present invention showing the watch casing open with the object within the watch casing.
Figure 1G:
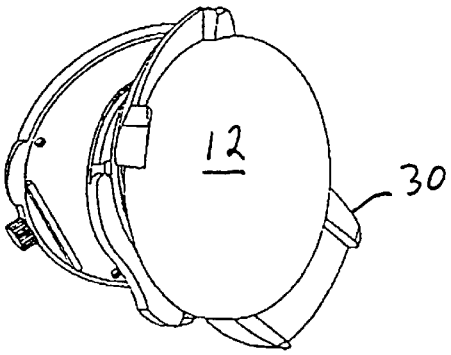
FIG. 1G is a rear perspective view of the present invention showing the watch casing open with the object within the watch casing.
Figure 2A:
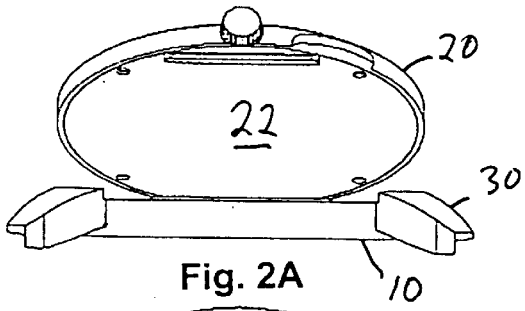
FIG. 2A is a side view of the present invention showing the watch casing open.
Figure 2B:
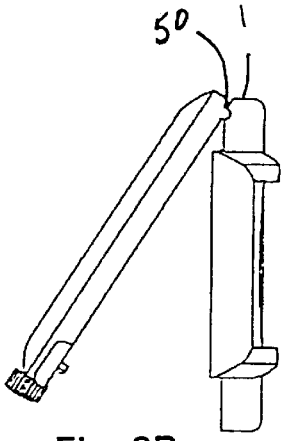
FIG. 2B is a side view of the present invention showing the watch casing open.
Figure 2C:
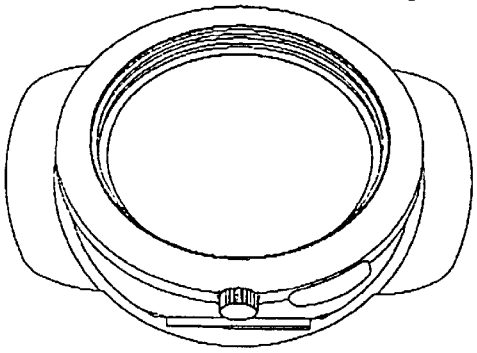
FIG. 2C is a top view of the present invention showing the watch casing open, without a watch face.
Figure 2D:
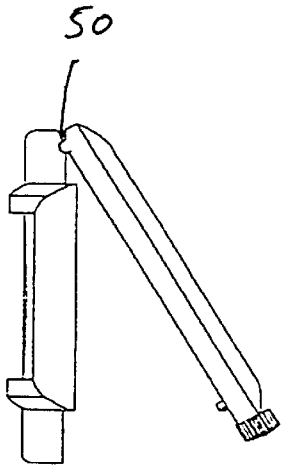
FIG. 2D is a side view of the present invention showing the watch casing open.
Figure 2E:
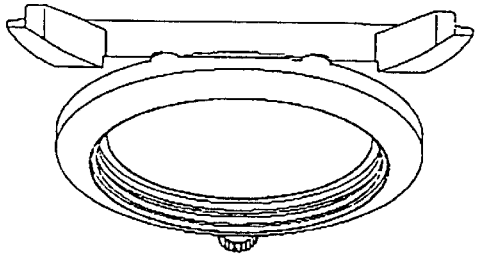
FIG. 2E is a side view of the present invention showing the watch casing open, without a watch face.
Figure 2F:
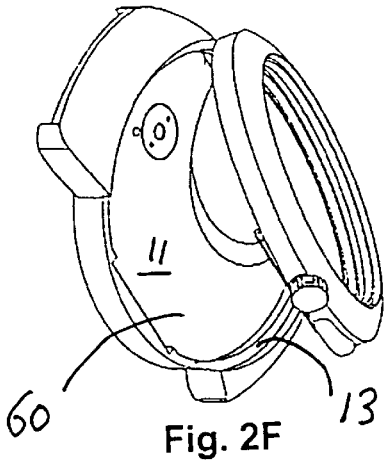
FIG. 2F is a perspective view of the present invention showing the watch casing open, without a watch face.
Figure 2G:
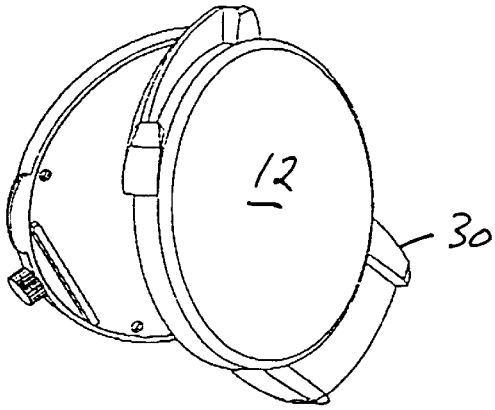
FIG. 2G is a rear perspective view of the present invention showing the watch casing open.
Figure 3A:
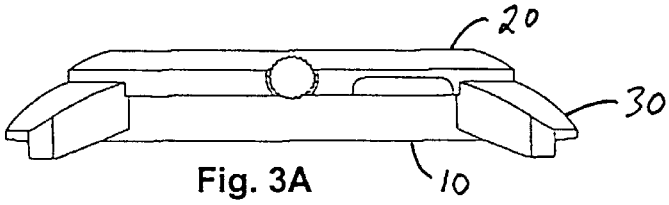
FIG. 3A is a side view of the present invention showing the watch casing closed.
Figure 3B:
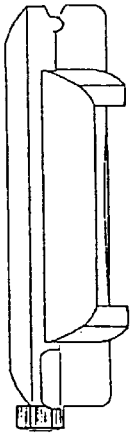
FIG. 3B is a side view of the present invention showing the watch casing closed.
Figure 3C:
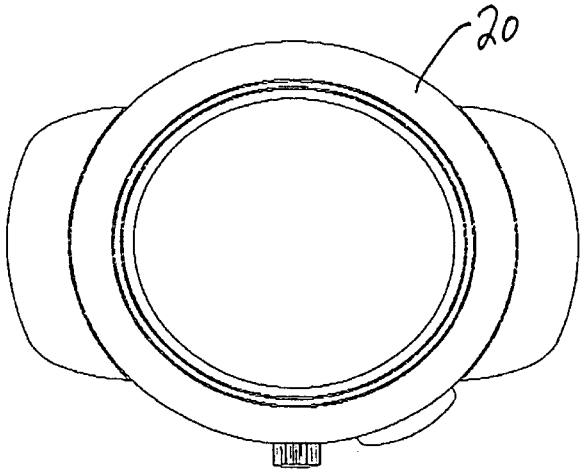
FIG. 3C is a top view of the present invention showing the watch casing closed, without a face.
Figure 3D:
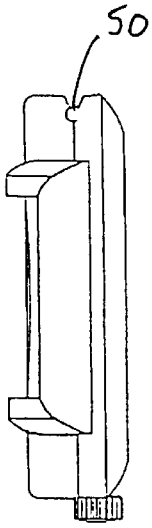
FIG. 3D is a side view of the present invention showing the watch casing closed.
Figure 3E:
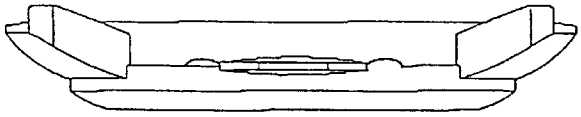
FIG. 3E is a side view of the present invention showing the watch casing closed.
Figure 3F:
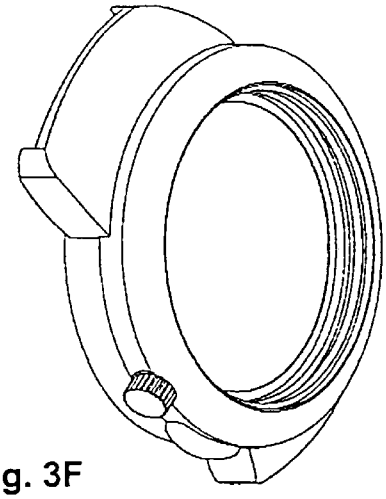
FIG. 3F is a perspective view of the present invention showing the watch casing closed, without a face.
Figure 3G:
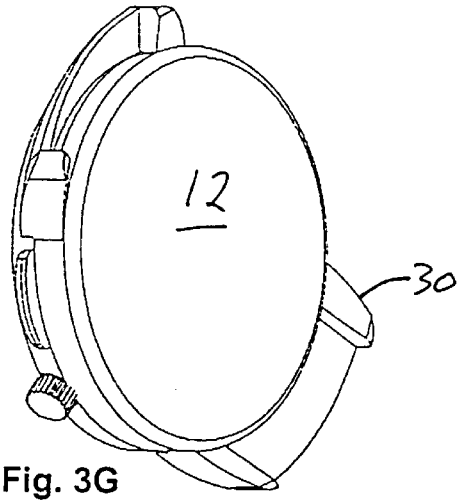
FIG. 3G is a rear perspective view of the present invention showing the watch casing closed.
Figure 4C:
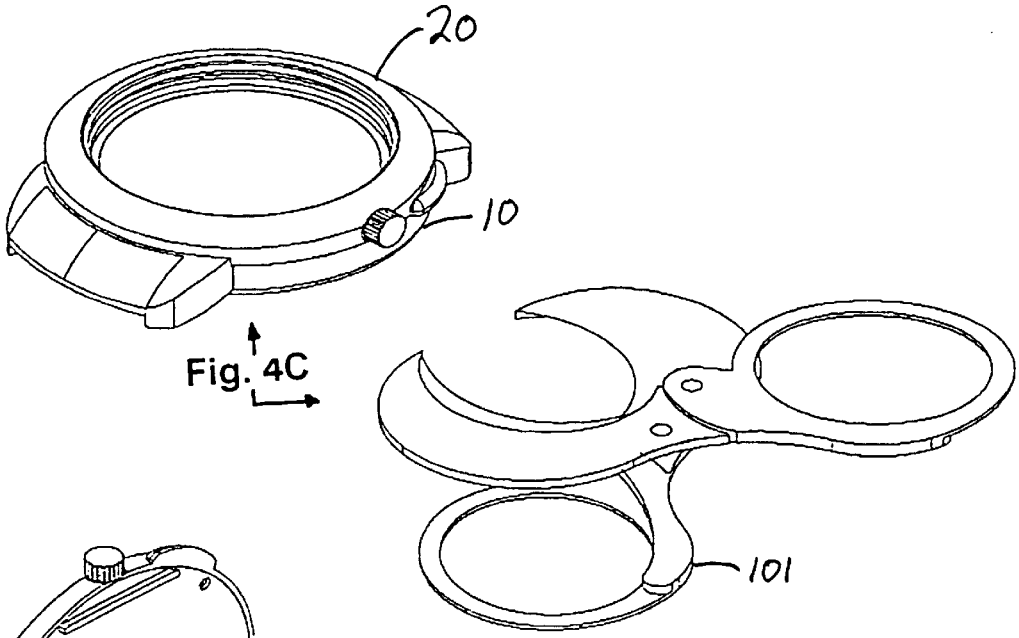
FIG. 4C is a perspective view of the present invention with the cigar cutter concealed within the watch casing.
Figure 4B:
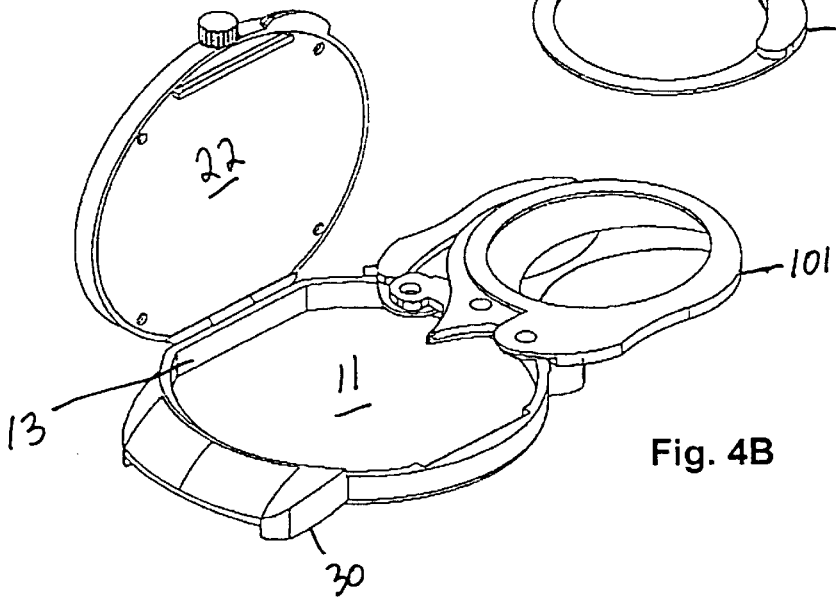
FIG. 4B is a perspective view of the present invention showing the now-folded cigar cutter being placed within the watch casing.
Figure 4A:
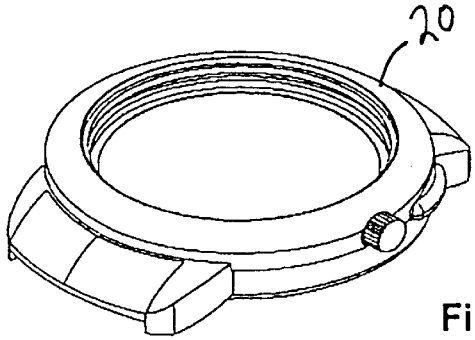
FIG. 4A is a perspective view of the present invention showing an open cigar cutter next to the closed watch casing, without a watch face on the watch casing.
Figures 5A, 5B, 5C, 5D, 5E:
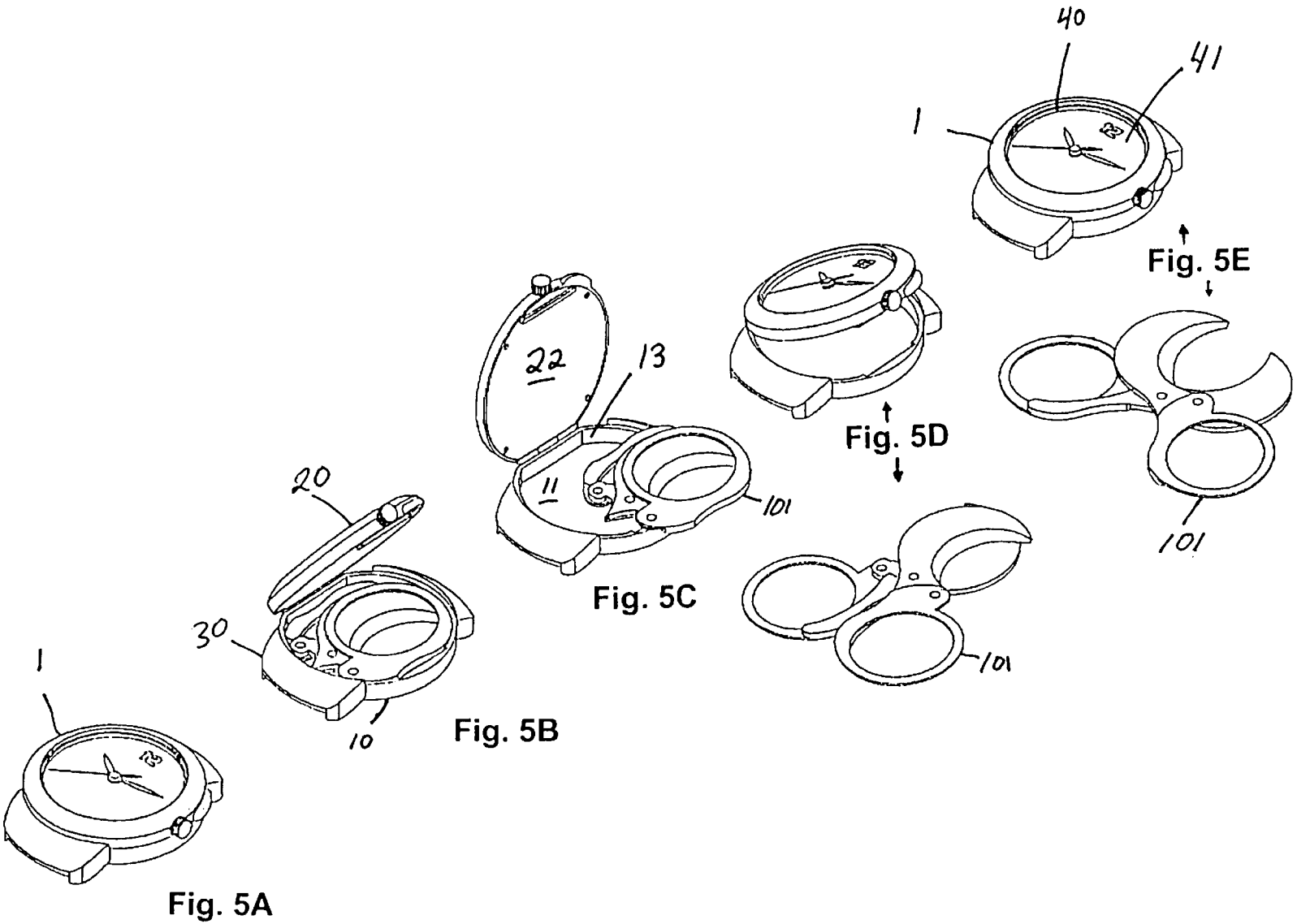
FIG. 5A is a perspective view of the present invention with the cigar cutter concealed within the watch casing.
FIG. 5B is a perspective view of the present invention where the watch casing is open to show the cigar cutter inside.
FIG. 5C is a perspective view of the present invention showing the folded cigar cutter being removed from the watch casing.
FIG. 5D is a perspective view of the present invention showing the closed cigar cutter next to the open watch casing.
FIG. 5E is a perspective view of the present invention showing the open cigar cutter next to the closed watch casing.

Referring to the drawings, the watch casing 1 comprises a base 10, which base may be supported by a watch band (not shown) by support means 30, and a lid 20. In the preferred embodiment, the watch mechanism 40 and watch face 41 are integrated on the lid 20 and may be of any of various types of watch mechanisms as are known in the art. Lid 20 is moveably attached to the base 10, where the lid may move from an open position to a closed position, by means of moveable connection 50. In the preferred embodiment, moveable connection 50 is a hinge.

In the open position, the lid 20 reveals a compartment 60 formed in the base, wherein an object 100 may be located. Compartment 60 is formed by a bottom wall 11 and at least one side wall 13. Lid 20 may also comprise a compartment (not shown), where one or both compartments, those for the base and/or for the lid allow for objects to be stored within the watch casing.

The watch mechanism 40 may be entirely located in the lid 20, including the means for powering the watch. Alternatively, lid 20 may comprise only the watch face 41, with elements of the watch mechanism 40, including the means for powering the watch located in the base 10. In such an alternate embodiment, a power connection to the watch mechanism 40 in the lid 20 may be located near the moveable connection 50 between the lid 20 and the base 10.

The watch casing 1 may incorporate any of a variety of means for maintaining the lid 20 in the closed position relative to the base 10 and to prevent unwanted opening, such as magnetic or mechanical locking.

The object 100 may be independent from the watch casing 1, or may be attached to or integral with the watch casing. In the drawings, the object 100 is a foldable cigar cutter 101, as an example of the type of object for which the present invention is suited. The watch casing 1 may be incorporated into the object 100, such that the watch casing 1 is an integral part of the object 100.

In the preferred embodiment, object 100 may be entirely contained within the watch casing 1. Alternatively, object 100 may extend beyond watch casing 1, even when lid 20 is in the closed position relative to base 10.

While certain novel features of this invention have been shown and described, it will be understood that various omissions, substitutions and changes in the forms and details of the device illustrated and in its operation can be made by those skilled in the art without departing from the spirit of the invention.

I claim:

1. In combination watch casing and a cutter, watch casing comprising a base and a lid moveably connected to the base, the lid being capable of moving between an open position and a closed position relative to the base, said lid comprising a watch face, where at least one of the base and lid comprises a recess, the recess being of a size at least large enough to contain a major portion of the cutter, the cutter being foldable upon two pivots to reduce its size to fit within the recess of the watch casing.

2. The watch casing of claim 1, where the lid comprises a watch mechanism.

3. The watch casing of claim 1, where the base comprises a watch mechanism.

4. The watch casing of claim 1, cutter having a curved blade.

5. The watch casing of claim 1, where the object is connected to the base.

6. In combination watch casing and a cutter where the watch casing comprises a base and a lid moveably connected to the base, the lid being capable of moving between an open position and a closed position relative to the base, said lid comprising a watch face, and where at least one of the base and lid comprises a recess capable of concealing the cutter, the cutter being foldable upon two pivots to reduce its size to fit within the recess of the watch casing.

7. The watch casing of claim 6, where the cutter is a cigar cutter having a curved blade.

8. In combination watch casing and a cigar cutter, where the watch casing comprises a base and a lid moveably connected to the base, the lid being capable of moving between an open position and a closed position relative to the base, said lid comprising a watch face, where at least one of the base and lid comprises a recess capable of concealing the cigar cutter, when the lid is in a closed position, the cutter being foldable on two pivots to reduce its size to fit within the recess of the watch casing.

9. The watch casing of claim 8, where the watch casing is moveably connected to the cigar cutter.

* * * * *